United States Patent [19]

Lowe

[11] Patent Number: 5,061,501

[45] Date of Patent: Oct. 29, 1991

[54] DISPLAY PACKAGE FOR MEAT ITEM

[76] Inventor: David M. Lowe, c/o LeanPak, Inc., 833 W. Chicago Ave., Chicago, Ill. 60622

[21] Appl. No.: 356,678

[22] Filed: May 23, 1989

Related U.S. Application Data

[63] Continuation of Ser. No. 106,634, Oct. 9, 1987, abandoned.

[51] Int. Cl.[5] ..... B65D 85/00

[52] U.S. Cl. ..... 426/124; 206/45.33; 229/8; 229/87.06; 426/129

[58] Field of Search ..... 426/129, 124, 121; 206/45.33; 229/87 F, 8

[56] References Cited

U.S. PATENT DOCUMENTS

| | | | |
|---|---|---|---|
| 2,940,861 | 6/1960 | Hultkrans | 229/87 F |
| 3,155,303 | 11/1964 | Fenkel | 426/124 |
| 3,191,849 | 6/1965 | Gutowski et al. | 426/129 |
| 3,215,333 | 11/1965 | Stelzer | 426/129 |
| 3,335,848 | 8/1967 | Frankenberg et al. | 206/45.34 |
| 3,575,287 | 4/1971 | Graveley | 206/45.33 |
| 3,730,738 | 5/1973 | Cook et al. | 426/129 |
| 3,833,742 | 9/1974 | Wetmore et al. | 426/129 |
| 3,916,030 | 10/1975 | Bard et al. | 426/129 |
| 3,929,222 | 12/1975 | Smith et al. | 229/8 |
| 4,032,005 | 6/1977 | Vereb | 229/8 |
| 4,057,651 | 11/1977 | Florian | 426/129 |
| 4,125,633 | 11/1978 | Vander Lugt, Jr. | 229/87 F |
| 4,375,482 | 3/1983 | Maroszek et al. | 229/87 F |
| 4,494,689 | 1/1985 | Ilitch | 206/45.33 |

FOREIGN PATENT DOCUMENTS

| | | | |
|---|---|---|---|
| 0627781 | 9/1961 | Canada | 426/124 |
| 1378140 | 12/1974 | United Kingdom | 426/124 |

*Primary Examiner*—Virginia Manoharan

[57] ABSTRACT

A package to display a meat item has a tray with a support surface on which a meat item can be placed and an envelope defining a pocket for reception of the tray with the meat item thereon. The envelope has an open end to facilitate introduction of the tray into the pocket. There is cooperating structure on the tray and envelope to maintain the tray with the meat item thereon in a display position within the envelope. An opening is provided in one wall of the envelope to permit viewing of the meat item on the tray in its display position. A well beneath the tray accumulates juices escaping from the meat item.

1 Claim, 1 Drawing Sheet

DISPLAY PACKAGE FOR MEAT ITEM

This application is a continuation now abandoned of application Ser. No. 106,634filed Oct. 9, 1987.

BACKGROUND OF THE INVENTION

1. Field of the Invention

This invention relates to packaging to preserve and display meat items for sale in retail establishments.

2. Background Art

Meat items are generally individually packaged to facilitate inspection by consumers in retail establishments. Commonly a meat item is placed in a tray and the tray and meat item are collectively wrapped by a layer of clear plastic. Alternatively, the tray is omitted and the meat item is independently wrapped in like fashion.

The conventional packaging described above has two notable drawbacks. First, fresh meats bleed, and if the juices escape through the wrap, the package becomes sticky and distasteful to its handler. The problem of leakage is aggravated by the fact that the wrap is generally drawn tightly against the upwardly facing surface of the meat and sealed loosely on the bottom of the package where the juices accumulate. The escaping juices, besides the inconvenience they cause the consumer, flow into display cases, thereby necessitating frequent cleaning thereof.

An additional problem with conventional packaging is that there is generally little room for the purveyor of the meat to describe the contents thereof. Most commonly, a small, self-adhesive label is placed on the upwardly facing surface of the wrap. To minimize obstruction of the meat item, the label is generally made with only enough room to conveniently identify the type of meat and its price.

SUMMARY OF THE INVENTION

The present invention is specifically directed to overcoming the above-enumerated problems in a novel and simple manner.

The invention contemplates a novel package for displaying a meat item. The package has a tray with a support surface on which a meat item can be placed and an envelope defining a pocket for reception of the tray with the meat item thereon. The envelope has an open end to facilitate introduction of the tray into the pocket. There is cooperating structure on the tray and envelope to maintain the tray with the meat item thereon in a display position within the envelope. An opening is provided in one wall of the envelope to permit viewing of the meat item on the tray in its display position. A well beneath the tray accumulates juices escaping from the meat item.

With the inventive structure, the meat item can be placed on the tray and wrapped in conventional manner. The wrapped meat and tray can then be inserted into the envelope pocket, by sliding movement of the tray lengthwise relative to the envelope through the envelope open end, so that the envelope acts as a second barrier to prevent exposure of the consumer to juices from the meat.

At the same time, the envelope affords a substantial surface area on which description of its contents and other information useful to the consumer can be placed.

In a preferred form, the envelope is formed from a single blank of cardboard or other flexible, formable material.

To facilitate placement of the meat item within the envelope, at least one end of the envelope has an opening and an associated flap that is foldable to selectively close the opening and permit access to the envelope pocket therethrough. Preferably, a curved, weakening fold line is provided on the flap, which is preferably on the bottom wall of the envelope. The flap is biased into and thereby maintained in its closed position. The user can thus simply situate the meat within the envelope pocket and fold the flap to the closed position without the necessity of gluing or otherwise fastening the flap in the closed position.

To enhance the integrity of the overall package, flaps can be provided at the opening on each of a top and bottom wall on the envelope and are foldable in like fashion into mutually overlying relationship. The envelope may take the form of a sleeve with flaps at both ends, which are closable in like fashion.

In a preferred form, the bottom wall has a curved, upwardly opening configuration. The tray, in its display position, bridges at least a portion of the curved bottom wall so that a well is defined beneath the bottom wall of the tray to accumulate any juices that may escape from the meat. The flap(s) on the bottom wall acts in conjunction with the bottom wall to define the well.

To facilitate viewing of the contents of the envelope, the top wall has a cutout over that portion of the item that is to be visible. The cutout can be strategically placed to not only make the contents of the envelope readily visible but to afford space on the top wall of the envelope for the placement of advertising material and the like.

DETAILED DESCRIPTION OF THE DRAWINGS

The meat display package according to the present invention consists of a tray 10 for supporting a meat item 12 and an envelope 14 for encasing the tray 10 with the meat item 12 thereon.

Figure 1:
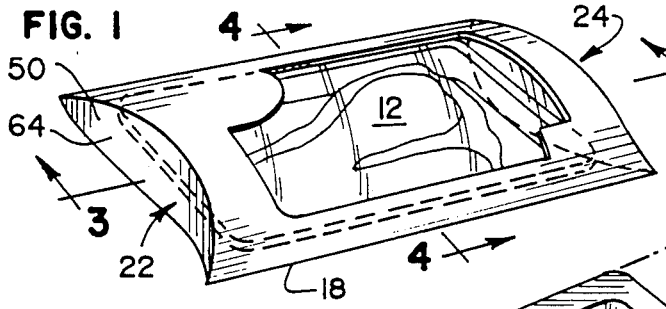
FIG. 1 is a perspective view of a meat display package according to the invention and consisting of an envelope, a tray and a meat item.
Figure 2:
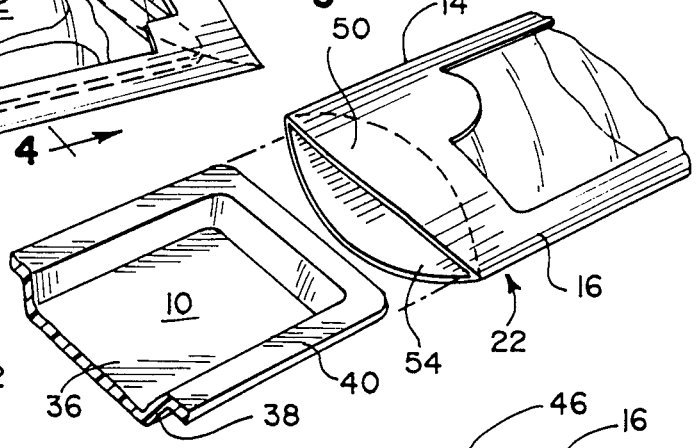
FIG. 2 is a perspective view of one end of the tray positioned to be introduced into an open end of the envelope.

The envelope 14 has a top wall 16 and a bottom wall 18 cooperatively defining a pocket 20, that is generally elliptical in cross section, for reception of the tray 10 with the meat item 12 thereon. The envelope 14 has spaced ends 22, 24, which can be selectively opened and closed, as described more fully below. With the end 22 open, as shown in FIG. 2, the tray 10 can be slid into the pocket to its display position, shown in FIGS. 1 and 3.

Figure 5:
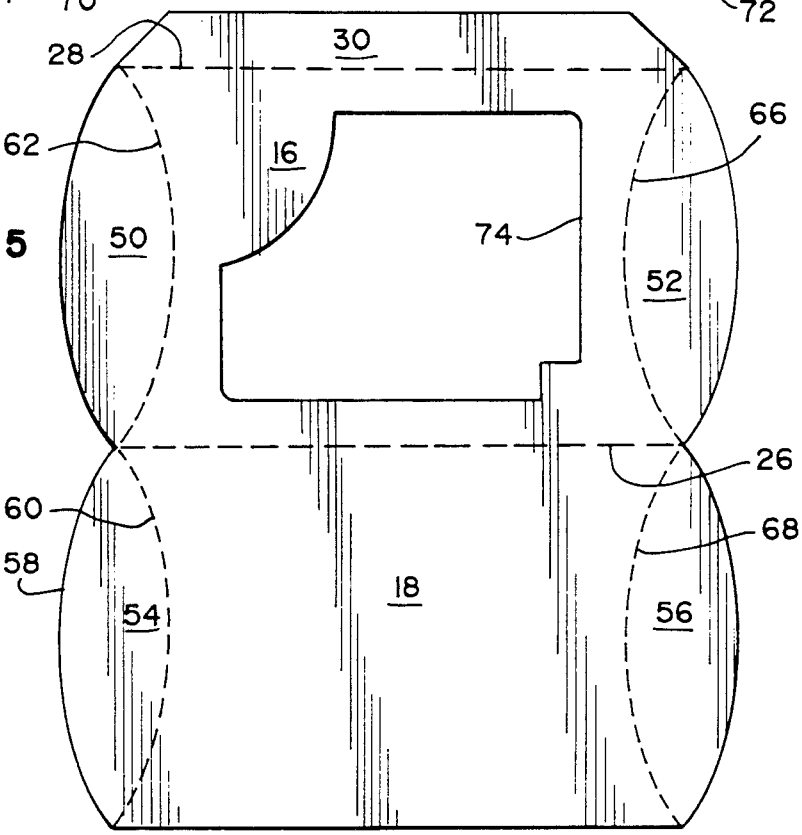
FIG. 5 is a plan view of a blank used to form the envelope.

The envelope 14 is preferably formed from a single blank of flat cardboard or other formable, flexible material, configured as shown in FIG. 5. The blank has a generally rectangular configuration with a weakening fold line 26 dividing the top wall 16 and bottom wall 18. The fold line may be a partial score, a perforation, or any other weakening known to those skilled in the art.

Figure 4:
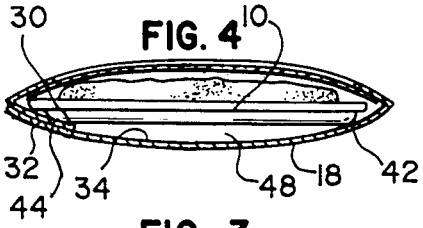
FIG. 4 is a section view of the meat display package along line 4—4 of FIG. 1.
Figure 3:
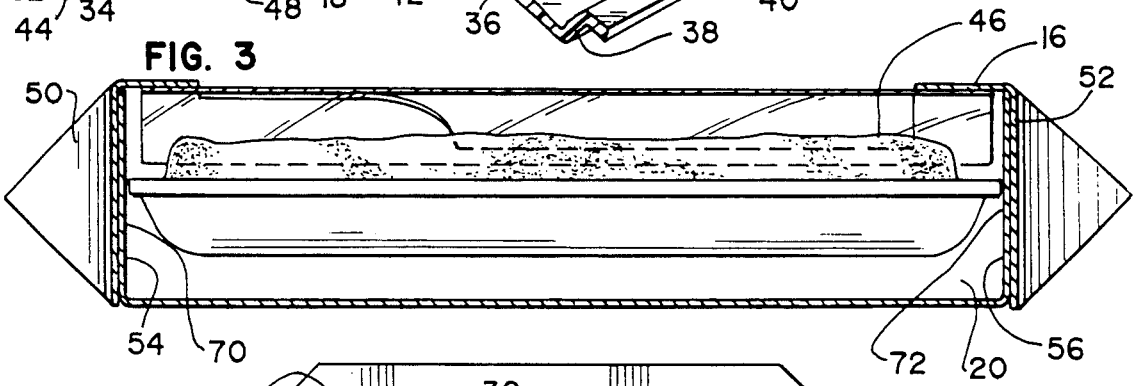
FIG. 3 is an enlarged, section view of the meat display package along line 3—3 of FIG. 1.

A separate, parallel fold line 28 is provided outside the top wall 16 to define a flap 30. The flap 30 has a surface 32 which is placed facially against the upwardly facing surface 34 on the bottom wall 18 and affixed thereto, as by gluing. The walls 16, 18 are slightly bowed as shown in FIG. 3 before the connection between the flap 30 and bottom wall 18 is established. The envelope 14 thus naturally retains the bulged shape in FIG. 4 to accommodate the tray 10, with access to the pocket 20 for the tray 10 gained through either end 22, 24 of the envelope 14.

The tray 10 has a bottom wall 36 for supporting the meat 12, an integral upturned edge 38 around the bottom wall 36 and an outturned flange 40 thereon. The bottom wall 36 blends into the edge 38 at curved, laterally spaced, parallel edges 42, 44. The tray 10 may be made from any suitable material, such as STYROFOAM, hard plastic, treated cardboard, and the like. A plastic wrap 46 surrounds the tray 10 with the meat 12 thereon in conventional manner.

To assemble the package according to the invention, the tray 10, with the meat item 12 thereon, is aligned with the one open end 22 of the envelope 14, as shown in FIG. 2. The tray 10 is guided into and out of the pocket by sliding its bottom edges 42, 44 in a lengthwise direction along the upwardly facing surface 34 on the envelope bottom wall 18. As seen clearly in FIG. 4, the edges of the tray bear on the upwardly facing surface of the bottom wall 18 over a substantial length of the envelope, and preferably over the entire length of the side edges of the tray, and thereby the tray 10 bridges the curved bottom wall 18 to define a well 48 below the tray bottom wall 18. The well 48 collects juices from the meat 12 that escape over the tray flange 40.

To confine the tray 10 and associated meat item 12 within the envelope 14, flaps 50, 52 and 54, 56 are provided on the envelope top wall 16 and bottom wall 18, respectively, at the opposite ends of the envelope 14. All of the flaps are similarly configured and exemplary flap 54 is used herein for illustration.

The flap 54 has a generally elliptical shape bounded by a curved free edge 58 and a similarly curved weakening fold line 60, each opening towards the other. With the envelope 14 in the FIG. 2 configuration, the flap 54 can be folded upwardly about the fold line 60. The flap 54 is effectively compressed by the bulged envelope 14 and as a result is biased into the closed position of FIG. 3 and will thus maintain itself in that position. The flap 50 folds similarly about the fold line 62 and is biasably urged into overlying relationship with the flap 50. The flaps 50, 54 define a curved face 64 at the envelope end 22. The flaps 52, 56 at the envelope end 24 are similarly folded about fold lines 66, 68 respectively. Movement of the tray lengthwise of the envelope 14 is limited by the facing surfaces 70, 72 on the closed flaps 54, 56 respectively. The flaps 50, 54 at the same time block the ends of the well 48 to confine any juices escaping from the meat item into the well 48.

A cutout 74 is provided in the top envelope wall 16 to permit viewing of the contents of the tray 10. The size and configuration of the opening is a matter of design choice. It can be seen that a substantial surface area on both the top and bottom walls as well as the exposed flaps 50, 52 is available to describe the contents of the envelope and/or to place advertising, nutritional information, etc. as the purveyor may choose.

At the same time, the described package affords a double barrier against the escape of juices from the meat item 12. Juices escaping through the plastic layer 46 surrounding the tray 10 and meat item 12 move into the trough 48 bounded by the bottom wall 18 and the surfaces 70, 72 on the flaps 54, 56 respectively, and are thereby confined.

I claim:

1. A display package comprising:

a meat item;

a tray having a length, a flat bottom wall for supporting the meat item, substantially parallel laterally spaced, downwardly facing side edges extending over substantially the entire length of the tray and a peripheral upturned edge;

said peripheral upturned edge in conjunction with the bottom tray wall defining an accumulation space for juices escaping from the meat item on said tray;

a one-piece envelope defining a pocket for reception of the tray having the meat item thereon and having spaced first and second open ends communicating with the pocket, a bottom wall, a top wall, first and second flaps on the top and bottom walls respectively adjacent one of the first and second envelope ends and third and fourth flaps on the top and bottom walls respectively adjacent the other of the first and second envelope ends, there being fold lines to facilitate folding of each of the first, second, third and fourth flaps relative to its respective wall between an open position wherein access can be gained to the pocket through each said envelope end and a closed position wherein the first and second flaps cooperatively close the one envelope end and the third and fourth flaps cooperatively close the other envelope end;

cooperating means on the tray and envelope for maintaining the tray with the meat item thereon in a display position within said pocket;

said cooperating means including a curved upwardly facing surface on the bottom envelope wall which bears against the tray side edges along substantially the entire length of the side edges with the tray in said display position so that the tray bridges the curved upwardly facing surface of the bottom envelope wall and a well is defined by the curved bottom envelope well beneath the tray to accumulated juices escaping from the meat item on the tray, said second flap blocking the well at the one envelope end and the fourth flap blocking the well at the other envelope end to confine juices escaping from the meat item in the wall below the tray in its display position, said envelope ends, with the flaps in their open position, permitting introduction of said tray into said pocket by sliding movement of said envelope side edges against the curved upwardly facing surface of the bottom envelope wall; and means in said top envelope wall for permitting viewing of a meat item on said tray with the tray in a display position.

* * * * *